US007942791B1

(12) United States Patent
Yocum

(10) Patent No.: US 7,942,791 B1
(45) Date of Patent: May 17, 2011

(54) DEVICE AND METHOD FOR HOLDING STRIKING TARGETS FOR USE IN THE PRACTICE OF MARTIAL ARTS

(76) Inventor: Aaron E Yocum, Allentown, PA (US)

( * ) Notice: Subject to any disclaimer, the term of this patent is extended or adjusted under 35 U.S.C. 154(b) by 1646 days.

(21) Appl. No.: 10/828,621

(22) Filed: Apr. 22, 2004

(51) Int. Cl.
*A63B 21/00* (2006.01)

(52) U.S. Cl. ..... 482/83; 482/35; 482/38; 482/41

(58) Field of Classification Search ..... 482/83–90, 482/35–42; 211/198, 199, 201; 248/205.2
See application file for complete search history.

(56) References Cited

U.S. PATENT DOCUMENTS 3,561,518 A * 2/1971 Johnson ..... 160/87
4,083,557 A 4/1978 Friedenthal ..... 272/76
5,476,433 A 12/1995 Bruner ..... 482/87
6,149,553 A 11/2000 Antoszewski ..... 482/83
6,280,351 B1 8/2001 Wong ..... 473/422
6,829,869 B1 * 12/2004 Savoie ..... 52/648.1

* cited by examiner

*Primary Examiner* — Jerome W Donnelly
(74) *Attorney, Agent, or Firm* — LaMorte & Associates, P.C.

(57) ABSTRACT

A board holding device for practicing a martial art and its associated method of use. The board holding device includes a framework that has a plurality of vertical rails. The vertical rails define sides of at least two striking planes. Connectors are disposed along each of the vertical rails. The connectors are used to selectively join striking boards to the vertical rails at any point along the vertical rails. In this manner, multiple striking boards can be placed across any or all of the striking planes. The striking boards can also be placed on the outside of the framework or on the inside of the framework. Thus, the striking boards can be arranged to be broken with a pushing blow or a pulling blow. The device enables a martial artist to arrange multiple striking targets at any position within multiple striking fields.

16 Claims, 3 Drawing Sheets

DEVICE AND METHOD FOR HOLDING STRIKING TARGETS FOR USE IN THE PRACTICE OF MARTIAL ARTS

BACKGROUND OF THE INVENTION

1. Field of the Invention

The present invention relates to devices that are used to hold striking targets, such as boards of wood, for a person who is practicing a martial art. More particularly, the present invention relates to devices that are used to hold more than one striking target in more than one orientation.

2. Description of Related Art

In many forms of martial arts, the skill of striking an object with hands or feet is practiced. By practicing the striking of hard objects, the muscles, tendons and bones of the hands, arms, feet and legs can be conditioned and strengthened. In this manner, a martial artist can strike objects much harder than flesh and bones without becoming injured.

There is a great variety of objects that are used to train the striking skills of a martial artist. Such objects include, punching bags, kicking bags, sand bags and the like. However, one of the most widely used and popular striking targets is the wooden board. A wooden striking board is traditionally a one-foot square board of pine. The pine is typically between of an inch and one inch thick. Such boards are used because they are relatively inexpensive and only break if they receive a forceful, well aimed blow. Thus, by practicing striking wooden boards, a martial artist not only conditions their body, the martial artist also learns accuracy and how to focus a blow.

Although pine boards are inexpensive, they do cost money and must be both purchased before use and disposed of after use. For this reason, reusable striking boards that simulate wood boards have been developed. Such simulated wood boards are typically comprised of molded plastic sections that snap together along a common joint line. The two sections come apart only when struck with a blow of sufficient force that is applied directly to the center of the board along the common joint. Once the two sections are separated by a blow, the two sections can be rejoined and the simulated board can be used again. Such reusable striking targets are exemplified by U.S. Pat. No. 4,083,557 to Friedenthal, entitled Reusable Karate Striking Board.

Regardless of whether a real wooden striking board or a reusable striking board is used, the striking board must be supported when it is struck. Of course, a person practicing martial arts can have another person hold the striking board. However, a willing and able volunteer is not always available. It is for this reason that board holding devices have been developed.

There are many types and styles of board holding devices. In a simple form, board holding devices exist that hold a single striking board in a single position. Such prior art board holding devices are exemplified by U.S. Pat. No. 6,149,553, to Antoszewski, entitled Martial Arts Board Holding Device.

However, when a martial artist is practicing striking, that martial artist may want to practice a combination of blows, where the martial artist strikes multiple locations with different blows as part of a single offensive attack. In practicing such combination attacks, a martial artist must set up multiple striking boards at multiple different positions. In the prior art, there do exist board holding devices that hold more than one striking board. Such prior art devices are shown by U.S. Pat. No. 6,280,351 to Wong, entitled Striking Practice Device and U.S. Pat. No. 5,476,433 to Bruner, entitled Universal Martial Arts Training Apparatus. However, the positions that such prior art devices hold the striking boards are set and can only be modestly adjusted. Thus, a martial artist is limited in his/her ability to position the striking boards in different positions for different combination blow attacks.

A need therefore exists for a more robust board holding device that can hold multiple striking boards in a wide variety of positions and orientations, so that a martial artist is less restricted in practicing combination blows. This need is met by the present invention as described and claimed below.

SUMMARY OF THE INVENTION

The present invention is a board holding device for practicing a martial art and its associated method of use. The board holding device includes a framework that has a plurality of vertical rails. The vertical rails define sides of at least two striking planes. Connectors are disposed along each of the vertical rails. The connectors are used to selectively join striking boards to the vertical rails at any point along the vertical rails. In this manner, multiple striking boards can be placed across any or all of the striking planes. The striking boards can also be placed on the outside of the framework or on the inside of the framework. Thus, the striking boards can be arranged to be broken with a pushing blow or a pulling blow, as desired by the martial artist.

The present invention device enables a martial artist to arrange multiple striking targets at any position within multiple striking fields. A martial artist can therefore practice combination blows that are customized to the physical requirements of that martial artist.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention board holding device can be used with real wood striking boards, it is better suited for use with reusable striking boards. In this manner, one set of reusable striking boards can be altered for use with the present invention and can be repeatedly used throughout the life of the device. Accordingly, in the embodiment of the present invention device that is illustrated and described, reusable striking boards are shown in order to set forth the best mode contemplated for the invention. However, it should be understood that real wood boards can be used in place of the reusable striking boards.

Figure 1:
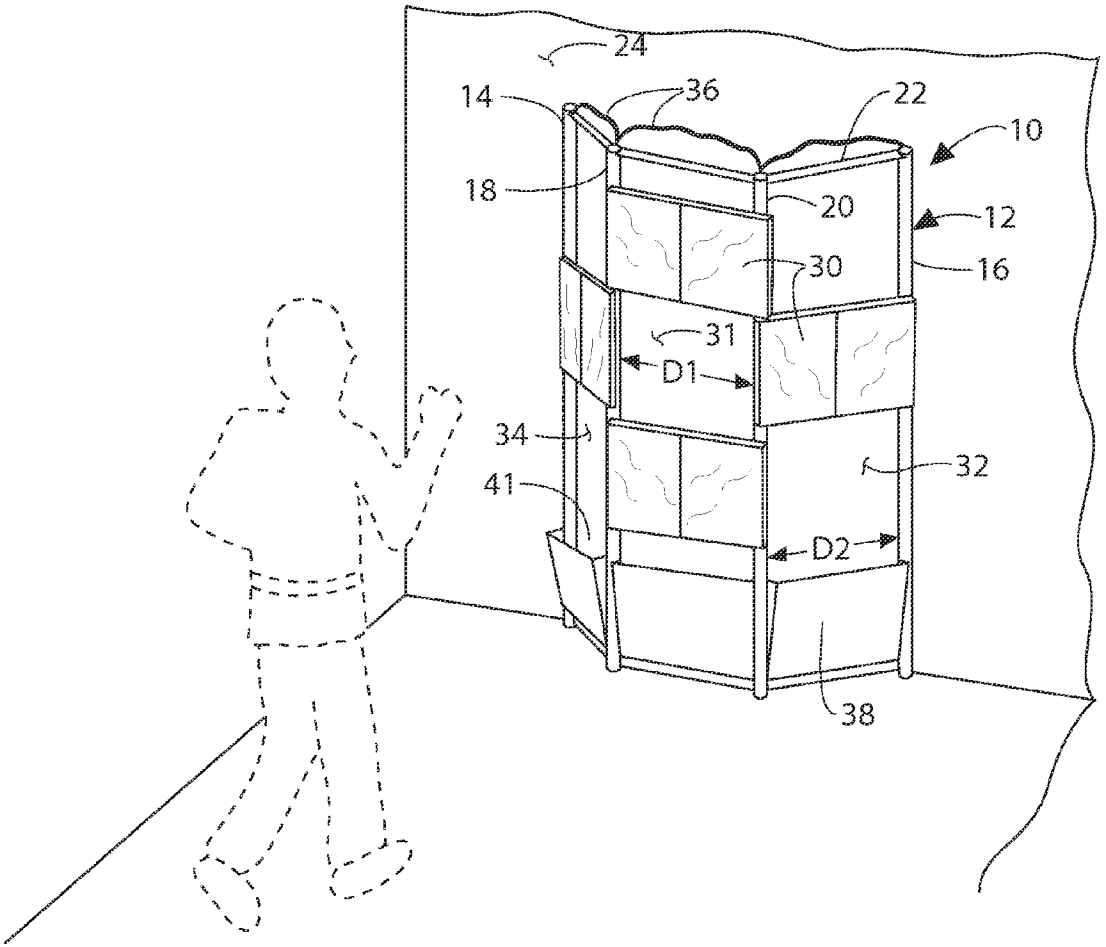
FIG. 1 is a perspective view of an exemplary embodiment of a board holding device in accordance with the present invention.

In FIG. 1, an exemplary embodiment of a board holding device 10 is shown. The board holding device 10 has a framework 12 that includes at least four vertical rails 14, 16, 18, 20. The four vertical rails include two front rails 18, 20 and two rear rails 14, 16 that are spread wider apart than are the two front rails 18, 20. All four of the vertical rails 14, 16, 18, 20 have a standing height of between four feet and eight feet, with a preferred height of about six feet. In this manner, the framework 12 has the same height as an average full grown man.

The vertical rails 14, 16, 18, 20 are joined together at the top of the framework 12 and at the bottom of the framework 12 with cross elements 22. In this manner, the vertical rails 14, 16, 18, 20 are rigidly set in position within the framework 12 of the device 10. The vertical rails 14, 16, 18, 20 are also preferably made of metal so that the vertical rails 14, 16, 18, 20 will not bend or fold when impacted by the hardest blow of a martial artist.

To further stabilize the framework 12, the framework can be mounted to a wall 24 and/or the ground. In this manner, when the framework 12 absorbs the striking blow from a martial artist, the framework 12 does not move and cannot be toppled by the blow.

In the embodiment of FIG. 1, the two front vertical rails 18, 20 lay in a common plane that is parallel to the mounting wall 24. The two front vertical rails 18, 20 are disposed a first distance D1 apart. This first distance D1 is slightly smaller than the length of the striking board 30 that is going to be used. For example, if the striking board 30 has a length of twelve inches, then the distance D1 between the front vertical rails 18, 20 would be about eleven inches.

The distance D2 between each front vertical 18, rail and each adjacent rear vertical rail 14, 16 is equal to the distance D1 between the two front vertical rails 18, 20. As such, the distance between each front vertical rail 18, 20 and each adjacent rear vertical rail 14, 16 is slightly less than the length of the striking board 30.

The left front vertical rail 18 and the right front vertical rail 20 are parallel and define the side of a front striking plane 31. The front striking plane 31 is parallel to the mounting wall 24. The right rear vertical rail 16 and the right front vertical rail 20 are parallel and define the sides of a right side striking plane 32. The right side striking plane 32 intersects the front striking plane 31 at an obtuse angle. Similarly, the left rear vertical element 14 and the left front vertical element 18 are parallel and define a left side striking plane 34. The left side striking plane 34 interests the front striking plane 31 at an acute angle that is complimentary to the obtuse angle made by the right side striking plane 32.

The framework 12 defines an internal region that exists between the four vertical rails 14, 16, 18, 20. Within this internal region of the framework are disposed three optional catch partitions 36. The catch partitions 36 are segments of tear resistant cloth that are suspended between the vertical rails 14, 16, 18, 20. A first of the catch partitions 36 is suspended behind the left side striking plane 34. A second of the catch partitions 36 is suspended behind the front striking plane 31. Finally, a third of the catch partitions 36 is suspended behind the right side striking plane 32.

Catch plates 38 can also be provided at the bottom of the framework 12. The catch plates 38 can be cloth, but are preferably rigid. The catch plates 38 are angled and extend forward out of the internal region of the framework 12. The catch plates 38 preferably do not extend any higher than one foot from the bottom of the framework 12. Thus, the catch plates 38 define the front of a catch pocket 41 that exists between the forward catch plate 38 and the rearward catch partition 36. The purpose of this catch pocket 41 is later explained.

Figure 2:
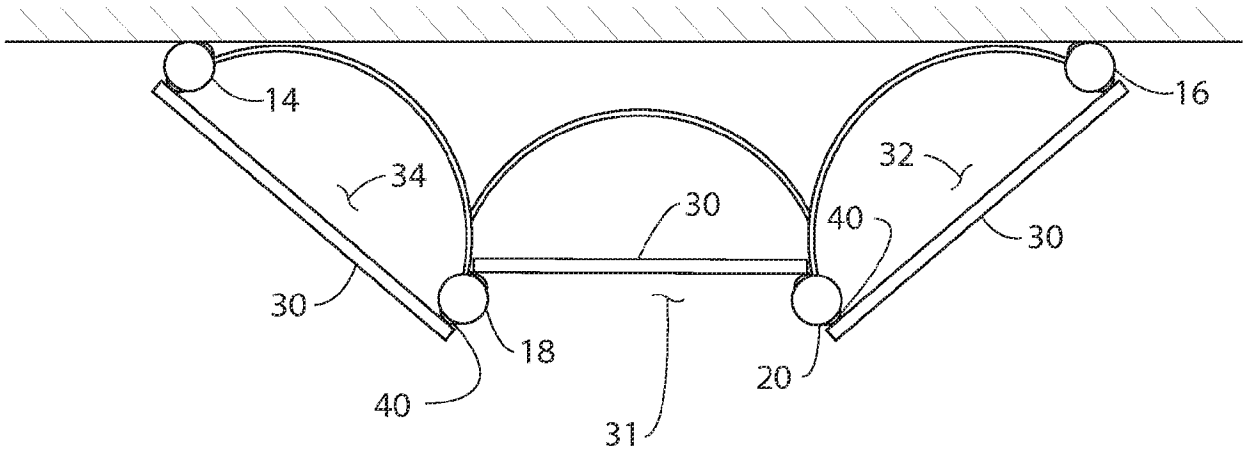
FIG. 2 is a top view of the embodiment of the present invention shown in FIG. 1.

Referring to FIG. 2, it can be seen that on each of the vertical rails 14, 16, 18, 20 are disposed connectors 40. The connectors 40 can be snaps, hooks, pegs or the like. However, in the preferred embodiment, the connectors 40 are segments of hook and loop material, such as Velcro. The connectors 40 are disposed along the length of each of the vertical rails 14, 16, 18, 20. The connectors 40 are disposed both on the face of each vertical rail 14, 16, 18, 20, facing outwardly, and on the rear of each vertical rail 14, 16, 18, 20 facing inwardly.

Connectors 42 are also provided on the face surface and the rear surface of each of the striking boards 30. The connectors 42 on the striking boards 30 align with and engage the connectors 40 on the vertical rails 14, 16, 18, 20 when a striking board 30 is placed against any two adjacent vertical rails.

In FIG. 2, it can be seen that the striking boards 30 can be placed across the left side striking plane 34, the front striking plane 31 and/or the right side striking plane 32. The striking board 30 being placed across the left side striking plane 34 and the right side striking plane 32 are shown being attached to the outside of the vertical rails that define those striking planes. However, a striking board 30 can also be place across the inside of any striking plane. In FIG. 2, a striking board 30 is place across the front striking plane 31. However, the striking board 30 is contacting the inside edge of the two vertical rails 18, 20 that define the front striking plane 31. Thus, the striking board 30 is positioned within the interior of the framework 12.

From FIG. 2, it will be understood that multiple striking boards 30 can be placed in each of the striking planes 31, 32, 34. The striking boards 30 can be placed either on the outside of the vertical rails 14, 16, 18, 20 or on the inside of the vertical rails 14, 16, 18, 20, as desired.

Figure 3:
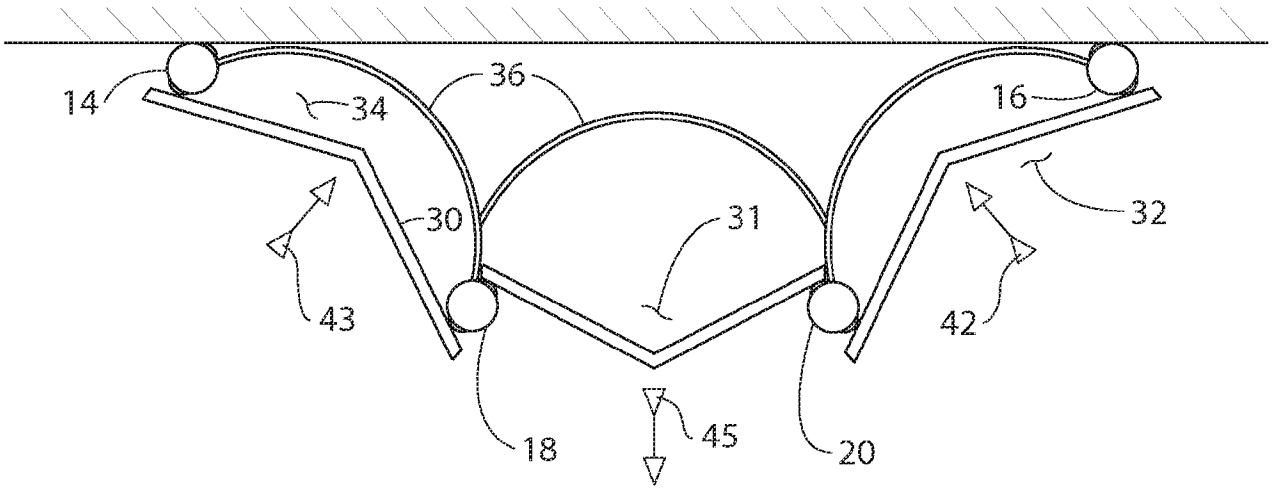
FIG. 3 is a top view of the embodiment of the present invention shown in FIG. 1 also showing the directions of blows to illustrate different blow types.

Referring to FIG. 3, the same configuration in FIG. 2 is shown where striking boards 30 are placed in each of the three striking planes 31, 32, 34. The striking board in the left side striking plane 34 is placed on the outside of the vertical rails 14, 18. This striking board 30 can be broken by hitting the striking board 30 with a forward blow, as is indicated by arrow 43. When the striking board 30 is hit and broken in two, the pieces of the broken striking board are confined by the catch partition 36. The broken pieces are then guided to the ground by the catch partition 36. Similarly, a striking board in the right side striking plane 32 is placed on the outside of two of the vertical rails 16, 20. This striking board 30 can be broken by hitting the striking board 30 with a forward blow, as is indicated by arrow 42. When the striking board 30 is hit and broken in two, the pieces of the broken striking board are confined by the catch partition 36. The broken pieces are then guided to the ground within the framework 12 by the catch partition 36. The broken pieces are then held in the catch pocket 41 (FIG. 1) until they are reassembled and reused.

In FIG. 3, the striking board 30 in the front striking plane 31 is placed against the rear of the front vertical rails 18, 20 inside the framework 12. In this orientation, the striking board 30 can only be broken with a pulling blow, as is indicated by arrow 45. Thus, it will be understood that by positioning the striking boards 30 either in the inside of the framework 12 or on the outside of the framework 12, the striking boards 30 can be set to practice either an outward striking blow or an inward pulling blow.

Referring lastly back to FIG. 1, it can be seen that a martial artist can place multiple striking boards 30 in each of the striking planes 31, 32, 34. The striking boards 30 can be placed at any height along the framework 12 and in any of the three striking planes 31, 32, 34. Furthermore, the striking boards 30 can be set to receive either striking blows or pulling blows.

When a martial artist stands in front of the device 10, that martial artist can practice many combination blows in three different planes. As the striking boards 30 are broken they fall and are caught by the catch pockets 41 at the bottom of the framework, where they can be readily retrieved, reassembled and reused.

It will be understood that the embodiment of the present invention device that is illustrated and described is merely exemplary and that a person skilled in the art can modify the shown forms. For example, in the described embodiment, the board holding device has four vertical rails and is mounted to a wall for support. It will be understood that more than four vertical rails can be used and the overall framework can be made to be free standing so a martial artist can circle the framework. All such alternate embodiments, modifications and variations are intended to be included within the scope of the present invention as claimed.

What is claimed is:

1. A striking board holding device for holding a striking board while practicing a martial art, said device comprising:

a plurality of striking targets each of said striking targets separable into separate pieces when impacted by a martial arts blow, a framework containing a plurality of vertical rails, wherein adjacent pairs of said plurality of vertical rails define sides of at least two striking planes;

connectors disposed along each of said vertical rails for selectively joining striking boards to said vertical rails at any point along said vertical rails; and a slack fabric barrier suspended between each of said adjacent pairs of said plurality of vertical rails, wherein said fabric barrier creates a catch partition that corrals falling pieces of a striking board once broken.

2. The device according to claim 1, wherein said at least two striking planes are not parallel.

3. The device according to claim 1, wherein said vertical rails define at least three non-parallel striking planes.

4. The device according to claim 1, wherein said vertical rails have inside edges that face into said framework and outside edges that face out of said framework, wherein said connectors are disposed on both said inside edges and said outside edges.

5. The device according to claim 1, wherein said connectors include hook and loop material.

6. A system for practicing martial arts, comprising:

a plurality of striking targets, each of said striking targets having a predetermined length, a front surface and a rear surface, wherein each of said striking targets is capable of separating into separate pieces when impacted with a sufficient martial arts blow;

at least one set of parallel vertical rails that define at least one striking plane;

a slack fabric barrier suspended between each said set of parallel rails for corralling said separate pieces of said striking targets after being impacted; and connectors disposed along said vertical rails and said striking targets for selectively joining striking targets to said vertical rails at any point along said vertical rails.

7. The system according to claim 6, wherein at least four vertical rails are provided that define at least three non-parallel striking planes.

8. The system according to claim 7, wherein each of said striking planes has a width slightly smaller than said predetermined length of said striking targets.

9. The system according to claim 6, wherein said connectors are selected from a group consisting of snaps, hooks, pegs and hook and loop material.

10. A method of mounting striking targets for practicing martial arts, said method comprising the steps of:

providing a plurality of vertical rails, wherein said vertical rails define sides of at least two non-parallel striking planes;

suspending a fabric barrier between vertical rails across each of said striking planes;

providing a plurality of striking targets;

selectively suspending at least some of said striking targets across at least one of said striking planes between said sides in front of said fabric barrier, wherein said fabric barrier corrals pieces of said striking targets as they are broken.

11. The method according to claim 10, wherein said plurality of vertical rails all have a length of at least six feet and said step of suspending at least some of said striking targets includes selectively attaching said striking targets to said vertical rails at different points along the length of said vertical rails.

12. The method according to claim 10, wherein said step of providing a plurality of vertical rails includes providing a framework of four vertical rails that define three striking planes.

13. The method according to claim 10, wherein said step of selectively suspending at least some of said striking targets includes selectively joining said striking targets to said vertical rails without hook and loop connectors.

14. The device according to claim 1, wherein each of said striking planes has a top and a bottom, and said device further includes a rigid catch plate extending across each of said striking planes proximate said bottom of said striking planes.

15. The system according to claim 6, wherein each said striking plane has a top and a bottom, and said system further includes a rigid catch plate extending across said striking plane proximate said bottom of said striking planes.

16. The method according to claim 1, wherein each of said striking planes has a top and a bottom, and said method further includes providing a rigid catch plate that extends across each of said striking planes proximate said bottom of said striking planes.

* * * * *